United States Patent [19]

Malm

[11] 4,092,704

[45] May 30, 1978

[54] HEADGEAR LIGHT

[76] Inventor: Douglas E. Malm, 2031 W. Palmyra, Apt.C., Orange, Calif. 92668

[21] Appl. No.: 831,244

[22] Filed: Sep. 7, 1977

[51] Int. Cl.[2] ..... F21L 15/14

[52] U.S. Cl. ..... 362/106; 362/105

[58] Field of Search ..... 362/105, 106, 107

[56] References Cited

U.S. PATENT DOCUMENTS 1,206,356 11/1916 Norton ..... 240/6.4 W

*Primary Examiner*—Stephen J. Lechert, Jr.

*Attorney, Agent, or Firm*—John N. Randolph

[57] ABSTRACT

A light unit for attachment to an item of headwear such as a fireman's helmet or a hard hat, and which includes a light source, and a current source for energizing the light source and for actuating electrically driven mechanical means for changing the direction of the light beam from the light source in response to movements of the head of the wearer of the headwear, enabling the beam of light to be directed either in a forward or a downward direction.

10 Claims, 4 Drawing Figures

HEADGEAR LIGHT

SUMMARY

It is a primary object of the present invention to provide a novel light unit for a helmet, hard hat or other headgear having means for directing the light beam from said unit in either a forward or a downward direction and which can be automatically controlled by movement of the head of the wearer of the headgear.

Another object of the invention is to provide such a light unit having means to retain the light beam in either its forward or downward direction, irrespective of movement of the head of the wearer of the headgear, at the option of the user.

A further object of the invention is to provide a light unit utilizing mercury switches and means for mechanically adjusting supports for said switches whereby the amount of tilting of the head which will be required to change the direction that the light beam is emitted from the unit can be varied.

Various other objects and advantages of the invention will hereinafter become more fully apparent from the following description of the drawings, illustrating a presently preferred embodiment thereof, and wherein:

DESCRIPTION OF THE PREFERRED EMBODIMENT

Figure 1:
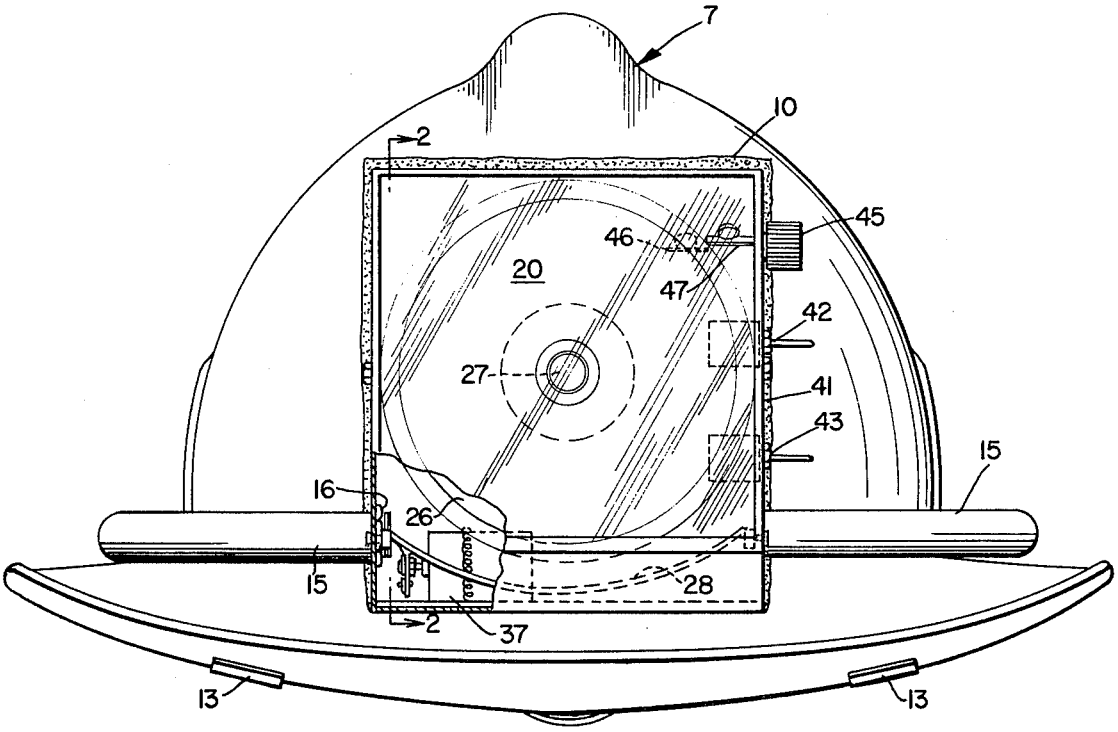
FIG. 1 is a front elevational view of a fireman's helmet with the light unit shown applied thereto.

Referring more specifically to the drawings, the headgear light in its entirety and comprising the invention is designated generally 6 and is shown applied to a conventional fireman's helmet 7 although it could be attached to other items of headwear, such as a hard hat. The light unit 6 includes an elongated housing 8 of substantially rectangular cross section having a rear wall 9 which is curved to conform to the shape of the front of the helmet 7, and which is secured thereto by suitable fastenings, not shown, which may extend through openings of the helmet, not shown, normally utilized for mounting fastenings of a helmet insignia. The housing 8 is cushioned relative to the helmet 7 by a sheet of foam material 10 which is interposed therebetween.

A battery pack 11 is mounted on the rear portion of the brim 12 of the helmet and is secured attachably thereon by clips 11 which form a part of the battery pack 11. A plurality of dry cell batteries 14 are detachably mounted in the pack or holder 11 and are connected together in series. Light weight metal tubes 15 extend from the ends of the holder 11 into the housing 8 through its side walls. The ends of the tubes 15 are retained in the holder 11 and housing 8 by nuts 16 which engage threaded terminals of said tubes and walls of the housing 8 and holder 11. Tubes 15 provide conduits for conductors, leading between the battery pack 11 and housing 8.

Housing 8 has an upwardly and rearwardly inclined front wall 18 provided with a large opening 19 covered by transparent plastic sheet or pane 20 forming a front window. A flat bottom wall 21 of the housing 8 has an opening 22 covered by a second plastic pane 23 of transparent material.

Rear wall 9 supports a bracket 24 in which a lamp socket 25 is mounted. A parabolic reflector 26 is supported by the socket 25 and extends forwardly therefrom. The socket 25 contains a conventional light bulb 27 which is disposed within said reflector 26. Socket 25 is readily detachable from the bracket 24 for changing the light bulb.

A mirror 28 is pivotally mounted as its forward edge at 29 within the housing 8, beneath and adjacent to the bottom edge of the front window 20. A rigid arm 30 extends downwardly from the mirror 28 adjacent its pivot 29 and is pivotally connected to a forward end of a rigid connecting rod 31 which extends rearwardly therefrom. The rear end of the connecting rod 31 is pivotally connected at 32 to the forward end of a rod 33 which has a threaded intermediate portion 34 and a rear portion defining an upwardly facing rack 35, which is slidably supported on a teflon bearing 36.

A reversible electric motor 37 is contained within the housing 8. A pinion 38 is fixed to the shaft of the motor 37 and meshes with the rack 35. A spring 39 engages over a housing of the motor 37 and has its ends anchored to the housing bottom 21 for urging the motor, its shaft and the pinion 38 downwardly into good meshing engagement of the pinion with the rack 35. The forward part of the rod 33 slidably engages a guide 40.

A side wall 41 of the housing 8, which is disposed remote from the motor 37, supports an off-on switch 42 and a hold switch 43, which switches are contained within the housing 8 with their manual operating arms projecting outwardly therefrom. A shaft 44 is supported for oscillation in the wall 41 and has a knob 45 secured to its outer end and disposed externally of the housing 8. Two platforms 46 and 47 are supported intermediate of their ends on the shaft 44 and crosswise thereof. As best seen in FIG. 1, said platforms are disposed in slightly different planes, staggered about five degrees relative to one another.

Platform 46 supports two mercury switches 48 and 49 and platform 47 supports two mercury switches 50 and 51, respectively. Two micro switches 52 and 53 are mounted on the housing bottom 21, between the window 23 and motor 37. Micro switch 52 is located between the motor 37 and the micro switch 53.

Figure 3:
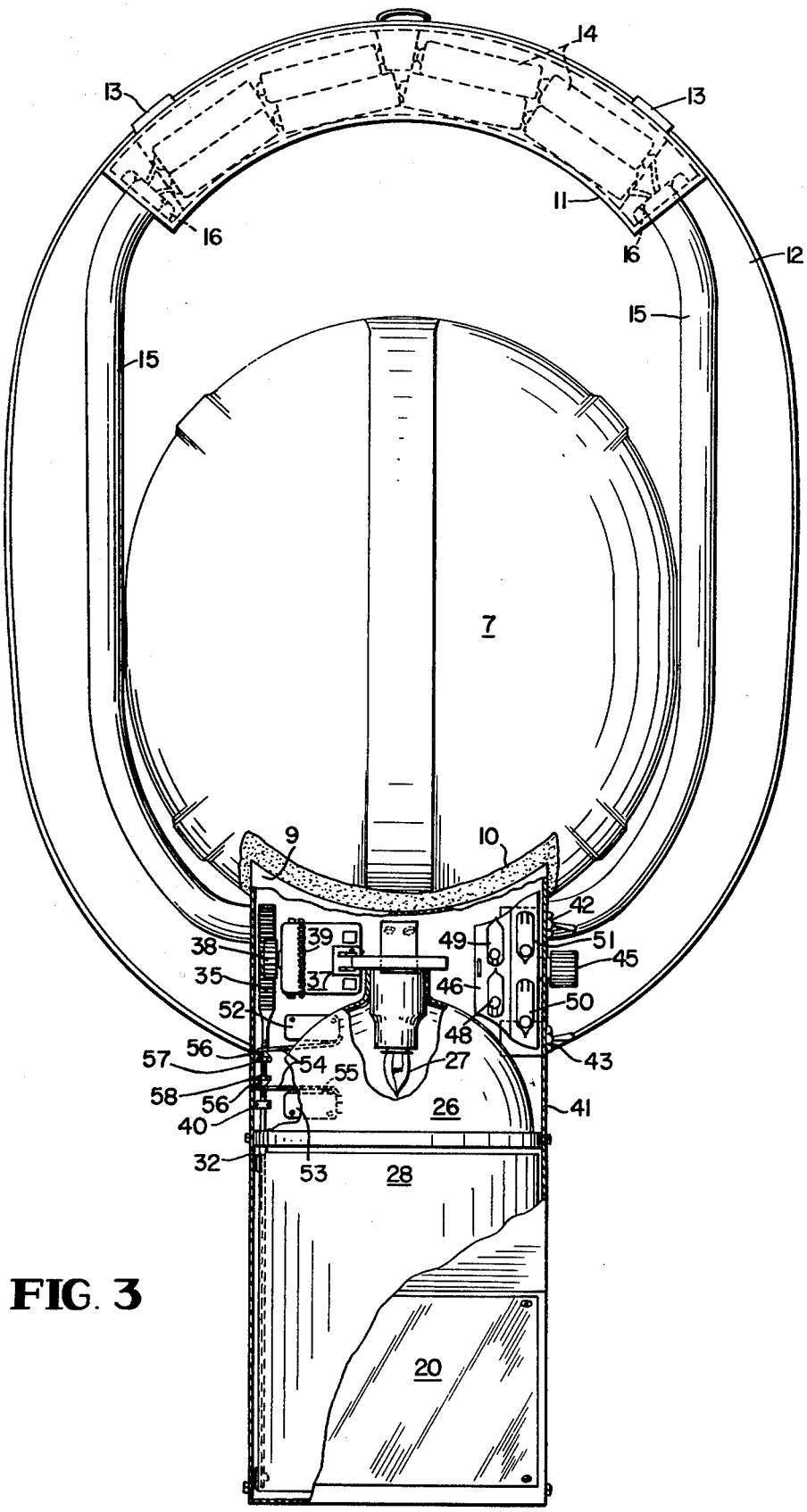
FIG. 3 is a top plan view partly broken away showing the complete unit applied to the helmet.

As best seen in FIG. 3, each micro switch has a spring leaf 54 which when displaced toward the body of its switch displaces a plunger 55 inwardly for opening one circuit of the switch and for closing another circuit thereof, as will hereinafter be described. Each leaf 54 carries a guide 56 which fits slidably on the rod 33. Nuts 57 and 58 are adjustably mounted on the threaded rod portion 34 between the guides 56.

Figure 4:
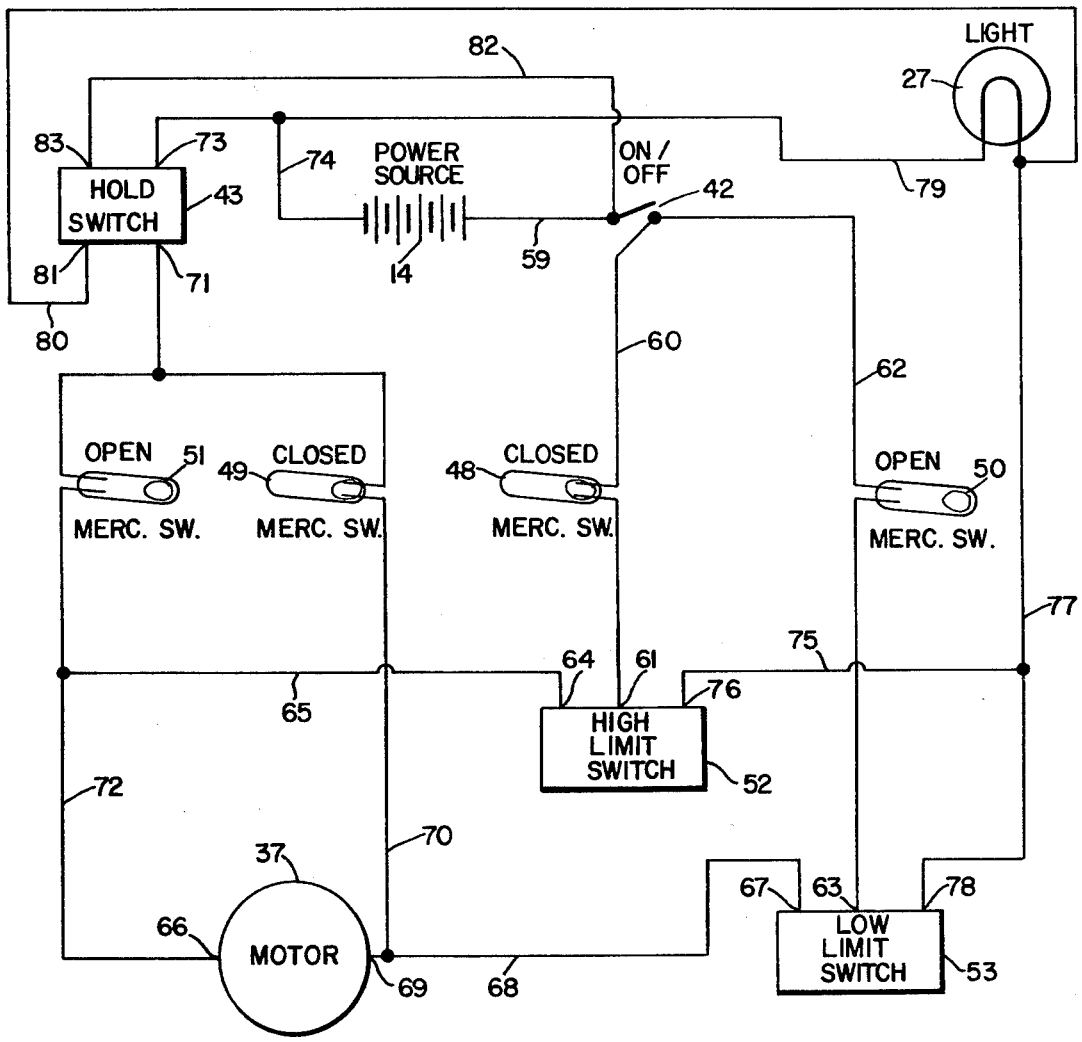
FIG. 4 is a diagramatic illustration of the electric circuits of the unit.

Referring to FIG. 4, the conductor 59 leads from the positive end of the power source 14 through one of the tubes 15 to the switch 42. A conductor 60 leads from the switch 42 to a terminal 61 of the micro switch 52. The mercury switch 48 is interposed in the conductor 60. A conductor 62 also leads from the switch 42 to a terminal 63 of the other micro switch 53 and has the mercury switch 50 interposed therein. A terminal 64 of the switch 52 is connected by wiring 65 to the terminal 66 of the motor 37. A terminal 67 of the switch 53 is connected by wiring 68 to the other terminal 69 of the motor 37. Wiring 70 connects the motor terminal 69 to a terminal 71 of the hold switch 43 and has the mercury switch 49 interposed therein. Wiring 72 connects the other terminal 66 of the motor 37 to the hold switch terminal 71 and has the mercury switch 51 interposed therein. The terminal 73 of the hold switch 43 is connected by wiring 74 to the negative terminal of the power source 14.

A conductor 75 leads from a third terminal 76 of the micro switch 52 and merges with a conductor 77 leading from a third terminal 78 of the micro switch 53 and which leads to the light source 27. A conductor 79 leads from the light source 27 back to the negative terminal of the power source 14 after connecting with conductor 74. A conductor 80 leads from a third terminal 81 of the hold switch 43 and connects with conductor 77. A conductor 82 leads from a fourth terminal 83 of the hold switch 43 and connects with conductor 59 between the current source 14 and switch 42.

Figure 2:
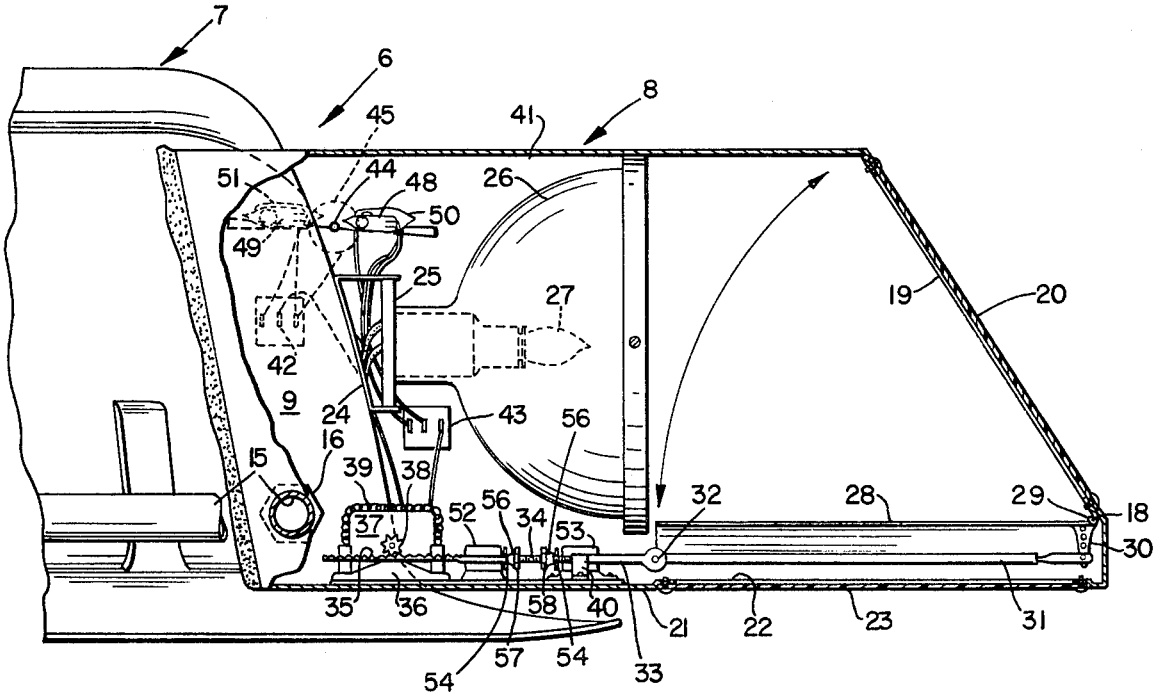
FIG. 2 is a fragmentary side elevational view, partly in vertical section, taken along a plane as indicated by the line 2—2 of FIG. 1.

In FIGS. 2 and 3, nut 58 is shown engaging guide 56 of the blade of micro switch 53 for holding the plunger thereof displaced inwardly while nut 57 is shown spaced from the guide 56 associated with micro switch 52. In FIG. 2, the mercury switches 48 and 49 are shown in open positions with the axis of the housing 8 disposed substantially in a horizontal plane so that the light rays from the bulb 57, when energized, will be directed by the reflector 26 straight to the front through the window 20. In FIG. 3, the housing 8 is shown tilted slightly downward, sufficient to cause the mercury switches 48 and 49 to close, also as seen in FIG. 4. Accordingly, if the switch 42 is closed, current will flow through conductor 60 and switch 48 to terminal 61 and a cross to terminal 64 which is normally closed, then through conductor 65 to the motor terminal 66, from the motor terminal 69 through conductor 70 and closed switch 49 to terminal 71 of the hold switch 43, which is normally in contact with terminal 73, which is connected with the negative terminal of the power source 14 by conductor 74, for driving the motor 37 in a direction for moving the rod 33 and connecting rod 31 rearwardly, as seen in FIG. 2. This will swing the mirror 28 upwardly to expose the bottom window 23 and cover the front window 20. In addition, nut 58 will be moved out of engagement with the guide 56 of micro switch 53, and nut 57 will move into engagement with guide 56 of micro switch 52 for deflecting its leaf 54 inwardly to reverse the switch 52. When this occurs, terminal 64 will be disconnected from terminal 61 and terminal 61 will be connected to terminal 76 for completing a circuit through conductors 75, 77, light bulb 27, conductors 79 and 74 to the negative terminal of the power source 14 for energizing the light bulb and deenergizing the motor 37.

The switch 43 can then be actuated by its manual switch arm for disconnecting the terminals 71 and 73 from one another and for connecting the terminal 81 to the terminal 83. This will disconnect the two micro switches, the four mercury switches and the motor from the power source 14 and provide a circuit only to the light source 27 through conductors 59, 82, 80, light source 27, and conductors 79 and 74, for retaining the bulb 27 energized irrespective of movement of the head of the wearer of the helmet 7.

The mirror 28 has a convex under or inner side, as seen in FIG. 1, so that when in its upper position, not shown, covering the window 20, light rays which are reflectd therefrom through the bottom window 23 will be elongated tranversely of the housing 8.

Assuming that the hold switch is returned to its initial, off position with the terminals 71 and 73 thereof bridged and the terminals 81 and 83 disconnected from one another, and with the light bulb 27 energized by current from the power source 14 passing across terminals 61 and 76 of switch 52, when the head of the wearer of the helmet 7 is raised, the mercury switches 48 and 49 will open simultaneously as the mercury switches 50 and 51 close. This will momentarily interrupt the circuit to the light source 27. Current will then flow from the closed switch 42 through conductor 62, including the closed mercury switch 50, to terminal 63 of switch 53, to terminal 67 which is connected thereto and through conductor 68 to the motor terminal 69. From the other motor terminal 66, current will flow to the terminal 71 through the closed mercury switch 51 and then back to the power source, for driving the motor 37 in the opposite direction to displace the rods 33 and 31 forwardly or from left to right to exert a thrust on the arm 30 for swinging the mirror 28 downward and back to its position of FIGS. 1 and 2. At the same time, nut 57 will move out of engagement with the guide 56, associated with switch 52, and nut 58 will move into engagement with the guide 56, associated with switch 53, for reversing said switch 53 to disconnect its terminals 63 and 67 and to connect terminal 63 to terminal 78, for deenergizing the motor 37 and for energizing the light source 27, as previously described, through conductor 77. Here again, if desired, the hold switch can be actuated for disconnecting everything but the light source 27 from the current source 14, as previously described.

Battery pack 11 and batteries 14 at least partially counterbalance the weight of housing 8 and its contents.

Various modifications and changes are contemplated and may be resorted to, without departing from the function or scope of the invention.

I claim as my invention:

1. In combination with an item of headwear, such as a helmet, a light unit comprising a housing secured to an extending forwardly from the headwear item, said housing having a forwardly opening window and a downwardly opening window, an electric light source mounted within said housing rearwardly of said windows and facing toward said front window, a current source electrically connected to said light source and supported by said headwear item, a mirror, and means swingably mounting said mirror within said housing for movement between said windows, said mirror in one position forming a shutter over said front window and a reflector for reflecting the light rays from the light source through said bottom window.

2. In a combination as defined by claim 1, electrically driven means connected to said current source and responsive to up and down swinging movement of said housing for moving said mirror back and forth between said windows.

3. In a combination as defined by claim 2, said electrically driven means including a reversible electric motor, rack and pinion means driven by said electric motor, a connecting rod connected to said rack and pinion means, and a lever secured to a part of said mirror and pivotally connected to said connecting rod.

4. In a combination as defined by claim 3, mercury switches supported by said housing and interposed in electric circuits of the light source and motor for completing electric circuits between the current source and motor for causing the motor to drive in either direction in response to tilting movement of the housing and for making and breaking electric circuits to said light source.

5. In a combination as defined by claim 4, micro switches supported by said housing and interposed in electric circuits of the motor, and means carried by said connecting rod for selectively activating said micro switches for interrupting operation of the motor.

6. In a combination as defined by claim 4, and a manually actuated switch supported by said housing for disconnecting the mercury switches and motor from the current source and for connecting the current source and light source.

7. In a combination as defined by claim 4, and manually actuated means for angularly adjusting the mercury switches for varying the amount of rocking movement required to open and close said switches.

8. In a combination as defined by claim 1, said mirror having a convex reflective surface positioned to reflect the light rays through said bottom window and for elongating the illuminated area transversely of the housing.

9. In a combination as defined by claim 1, said current source being disposed on the helmet remote from the housing to function as a counterbalance weight to the housing.

10. In a combination as defined by claim 7, and a manual switch supported by the housing for disconnecting the light source, motor and mercury switches from the current source.

* * * * *